US006531705B2

(12) United States Patent
White et al.

(10) Patent No.: US 6,531,705 B2
(45) **Date of Patent: *Mar. 11, 2003**

(54) CONTAINER FOR STORING AND SHIPPING RADIOACTIVE MATERIALS

(75) Inventors: Jack C. White, Alpharetta, GA (US); Joseph J. Rodgers, Gainesville, GA (US); Glenn A. Dill, Fayetteville, GA (US); Mary Christine Jacobs, Atlanta, GA (US)

(73) Assignee: Theragenics Corporation, Buford, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/969,393

(22) Filed: Oct. 2, 2001

(65) Prior Publication Data

US 2002/0074527 A1 Jun. 20, 2002

Related U.S. Application Data

(62) Division of application No. 08/266,867, filed on Mar. 12, 1999, now Pat. No. 6,323,501.

(51) Int. Cl.[7] ..... G21F 5/00

(52) U.S. Cl. ..... 250/496.1; 250/506.1; 250/507.1

(58) Field of Search ..... 250/496.1, 506.1, 250/507.1

(56) References Cited

U.S. PATENT DOCUMENTS

| | | | | |
|---|---|---|---|---|
| 3,256,441 A | | 6/1966 | Gratsy | 250/108 |
| 3,744,661 A | | 7/1973 | Fischer, Jr. | 220/21 |
| 4,151,912 A | | 5/1979 | Harrold | 206/338 |
| 4,501,360 A | | 2/1985 | Levy et al. | 206/443 |
| 4,759,345 A | * | 7/1988 | Mistry | 128/1.2 |
| 4,826,003 A | | 5/1989 | Levy | 206/45.31 |
| 4,847,505 A | | 7/1989 | Suthanthiran | 250/507.1 |
| 4,932,533 A | | 6/1990 | Collier | 206/569 |
| 4,997,090 A | | 3/1991 | Lenmark, Sr. et al. | 206/570 |
| 5,460,592 A | | 10/1995 | Langton et al. | 600/7 |
| 5,829,589 A | | 11/1998 | Nguyen et al. | 206/266 |
| 5,860,909 A | | 1/1999 | Mick et al. | 600/7 |

* cited by examiner

*Primary Examiner*—Bruce Anderson
*Assistant Examiner*—Nikita Wells
(74) *Attorney, Agent, or Firm*—Knoble & Yoshida, LLC

(57) ABSTRACT

A container for storing and transporting device containing radioactive materials used for medical procedures is disclosed. Such devices may include a radioactive shielding material which contains a portion of the radioactivity emitted by the radioactive material. The container has an upper portion and a lower portion, and at least one of the portions includes a radiation shielding material, such as lead, steel or other appropriate shielding materials. Devices containing radioactive material are placed within the container. The container secures the devices against lateral movement within the container. The radiation shielding material of the lower portion of the container may cooperate with the radiation shielding material of the device to contain more of the emitted radiation than is contained by the device alone. The container and the holder may be sterilizable to allow such devices to be transported and sterilized for medical use.

17 Claims, 3 Drawing Sheets

CONTAINER FOR STORING AND SHIPPING RADIOACTIVE MATERIALS

CROSS-REFERENCE TO RELATED APPLICATIONS

This application is a divisional of U.S. patent application Ser. No. 08/266,867, filed on Mar. 12, 1999, now U.S. Pat. No. 6,323,501 B1.

FIELD OF THE INVENTION

The present invention relates to containers for the storage and transportation of devices which contain radioactive material, preferably for shipping of radioactive seeds used for medical treatments.

BACKGROUND OF THE INVENTION

Radioactive materials may be used for treating various illnesses including tumors and nodules. For example, radioactive materials, such as iodine$^{125}$ palladium$^{103}$, or the like, may be implanted into a patient to provide localized radiation treatment of tumors.

It will be appreciated that such radioactive materials must be stored and transported in containers which protect patients, medical personnel and others that must handle the radioactive material from unnecessary exposure to radiation. Additionally, the radioactive materials must be packaged to allow safe transport from the manufacturer to an end user. Further, such radioactive materials must be safely packaged for storage at a facility, such as a warehouse or a hospital.

Conventional containers for transporting devices containing radioactive material are generally made of lead or steel or some other radiation shielding material. These containers, however, may be large, awkward, and heavy. Shipping such containers may be difficult, thereby increasing costs for the radioactive material, and discouraging return, cleaning and/or reuse of the containers.

One such existing container is made from a large block of steel having a handle formed integrally therewith. Within the steel block are formed a number of cylindrical cavities each for receiving a magazine containing radioactive seeds. Such steel containers are inordinately heavy and cumbersome and do not provide complete shielding of the radiation which escapes from the magazine.

Additionally, it is often necessary to sterilize medical equipment before use. The large size and weight of existing containers for magazines of radioactive seeds make them awkward to clean and/or sterilize. Also, these containers are unwieldy for handling the small quantities of radioactive material used in individual surgical procedures.

These and other drawbacks for presently available containers exist.

SUMMARY OF THE INVENTION

An object of the present invention is to overcome these and other drawbacks in existing containers.

Another object of the present invention is to provide a convenient, relatively lightweight container for storage and transportation of radioactive materials.

Another object of the present invention is to provide a container for transporting and storing devices housing radioactive material, wherein the container and the device cooperate to provide radiation shielding.

Another object of the present invention is to provide a container for transporting and storing devices housing radioactive material, whereby the devices are secured within the container to resist movement during transport and use.

Another object of the present invention is to provide a container for transporting and storing devices housing radioactive material, wherein the container includes a separate device holder which may be sterilized within or apart from the radiation shielding container, thereby easing the process of sterilizing the devices for use.

Another object of the present invention is to provide a container for transporting and storing devices housing radioactive material, wherein the devices are sealed within the container of the invention in a sterilized condition, thereby enabling transportation of sterilized devices.

These and other objects of the invention are accomplished according to various embodiments of the invention. One embodiment of the invention provides a container for storage and transportation of one or more devices each containing a plurality of individual dosage units of radioactive material. The container of the invention includes a radiation shielding material. The container also includes structure for retaining the devices within the container for transport. The container of the present invention is designed such that the container of the invention acts to contain at least some of the radiation emitted by the stored radioactive material.

Other objects and advantages exist for the present invention.

DETAILED DESCRIPTION OF THE PREFERRED EMBODIMENTS

The container of the present invention may be used for storage and transportation of one or more magazines housing radioactive materials. Nonetheless, the structures and characteristics of the invention are equally applicable to the storage and transport of other types of devices including radioactive material, such as preloaded needles as well.

Specific embodiments of the present invention, as will be illustrated further in FIGS. 1–7, provide a container for the storage and transportation of magazines containing radioactive material. Radioactive seeds, which are used in the treatment of tumors and other medical problems, are often housed in magazines which generally contain a plurality of such seeds. The magazines function to both contain the seeds and to ease their loading into the applicators used to introduce the seeds into the human body. Such magazines typically dispense one seed at a time in a predetermined manner and orientation which facilitates the loading of such seeds into their applicators for use. One such magazine is available from Mick Radio and is described in U.S. Pat. No. 5,860,909. Another is illustrated in FIGS. 1–7 herein. The invention is generally applicable to a variety of such magazines, as well as other devices containing radioactive material.

Figure 1:
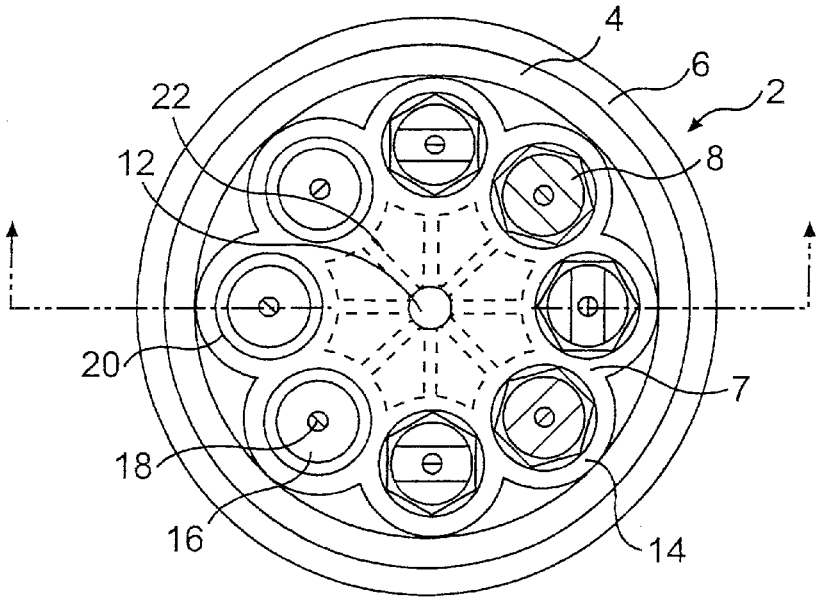
FIG. 1 illustrates a top view of a container according to a first embodiment of the invention.
Figure 2:
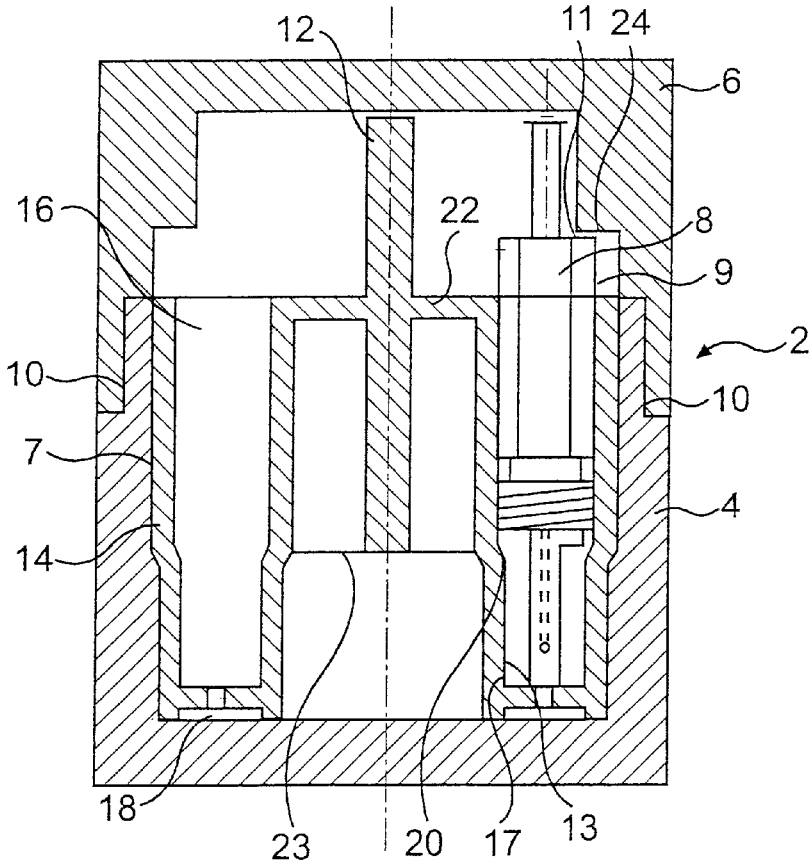
FIG. 2 illustrates a side view of the container shown in FIG. 1.

FIGS. 1 and 2 illustrate a first embodiment of a container 2 according to the invention for storing and transporting one or more magazines containing radioactive materials. Container 2 includes a lower portion 4 and an upper portion 6, which may be separated to allow access to the inside of container 2. Lower portion 4 may include a conventional radiation shielding material, such as lead, steel or other appropriate materials. In a more preferred embodiment of the invention, both upper portion 6 and lower portion 4 of container 2 include a radiation shielding material. Upper portion 6 and lower portion 4 of container 2 may be joined together by a closure 10. The closure may be a friction fit, a mechanical fastener, threads, a slip-fit, or other similar closing structures. The container may also be taped closed on the outside to provide additional security, and such tape may also contain a radiation shielding material.

A basket 7, which serves as a holder for magazines 8, may be located within lower portion 4 of container 2. Basket 7 also functions to isolate magazines 8 from contact with the lower portion 4 of container 2. Such isolation may be required depending on the materials used to fabricate lower portion 4 of container 2. Basket 7 may optionally include a handle 12 to facilitate removal of basket 7 from container 2. Magazines 8 may be placed in recesses 16 of basket 7 which are defined by sleeves 14 which function to surround and laterally support magazines 8. A drain port 18 may be located in the bottom of each recess 16 of basket 7 to allow liquids to drain from recesses 16 in order to facilitate cleaning and sterilization of basket 7 including the inner surfaces of sleeves 14. Recesses 16 may be customized to conform to the specific shape of the magazines 8 or to help properly align magazines 8 in recesses 16 during insertion, such as, for example by providing a narrower section of recesses 16 formed by shoulder 20 in sleeve 14. Magazines 8 may optionally be secured in recesses 16 by threads 13 on magazines 8 which mate with threads 17 in recesses 16. Sleeves 14 are preferably connected to one another by ribs 22 which, optionally, may all connect at a handle 12 if such is included as part of basket 7. Secondary ribs 23 may also be provided to enhance the mechanical integrity of basket 7.

In a preferred embodiment of the invention, basket 7 is made of a sterilizable material. Basket 7 may be removed from container 2, and be separately placed in a sterilization unit, such as an autoclave or chemical disinfection, chemical sterilization or other conventional means of sterilization, or may be sterilized while within lower portion 4 of container 2. Thus, basket 7 may act as a simple transfer device for handling one or more magazines 8 prior to, and during use. Basket 7 may be injection molded from, for example, nucleated polypropylenes, polysulfones, polycarbonates, high temperature acrylics or polyether sulfones. Other conventional materials and/or methods of making basket 7 may also be employed. In another embodiment, container 2 may itself be sterilized, such as by an autoclave or other conventional means, thereby allowing sterilized magazines 8 to be sterilized directly in container 2 or stored or transported in container 2 in sterilized condition.

Referring still to FIGS. 1–2, upper portion 6 may also include a shoulder 24 which may be used to substantially secure magazines 8 against vertical movement in basket 7, when upper portion 6 and lower portion 4 are associated to form container 2. As described previously, magazine 8 may comprise a casing having an upper surface 11. When a magazine 8 is placed into recess 16 of basket 7, located in lower portion 4 and upper portion 6 is placed on lower portion 4 to enclose basket 7, shoulder 24 is positioned closely adjacent to, or in abutment with, the upper surface 11 of each magazine 8. Shoulder 24 thereby substantially secures magazine 8 in the vertical direction to minimize or prevent vertical movement of magazines 8 during transport.

Basket 7 of container 2 allows magazines 8 to be transported and sterilized easily, e.g., within a medical facility. Ease of transportation helps to minimize handling, thereby reducing the potential for exposure to radiation. A lightweight basket 7 also reduces the overall weight of container 2, thereby reducing transportation costs and facilitating the handling of container 2.

To use the container shown in FIGS. 1–2, one or more magazines 8 containing radioactive material are placed in recesses 16 of basket 7. Basket 7 is located in lower portion 4 of container 2. In this configuration, without upper portion 6, the radiation shielding material included in lower portion 4 may cooperate with radiation shielding 9 of magazine 8 to together contain a substantial portion of radiation emitted by the radioactive material when the magazine 8 is the type which includes its own radiation shielding material. Thus, the potential for exposure to radiation, even with the container 2 in the open position, is minimized due to either the radiation shielding of the lower portion 4 of container 2, or due to the cooperative shielding provided by the radiation shielding 9 of magazine 8 and the lower portion 4 of container 2.

Magazines 8 may be fitted into recesses 16 of lower portion 4 by a friction fit, mechanical fastener, slip-fit or by a thread 17, provided on the inner surface of the sleeve 14 and the cooperating thread 13 provided on the outer surface of magazine 8. Subsequently, upper portion 6 is fitted onto lower portion 4 such that the closure 10 holds upper portion 6 in place on lower portion 4. In this manner, shoulder 24 is positioned closely adjacent to, or in abutment with, upper surface 1I1 of magazine 8 to thereby minimize or prevent vertical movement of magazine 8 within recess 16 during storage and transport. Upper portion 6 may also optionally include a radiation shielding material to provide additional shielding against radiation emitted in the vertical direction.

Figure 3:
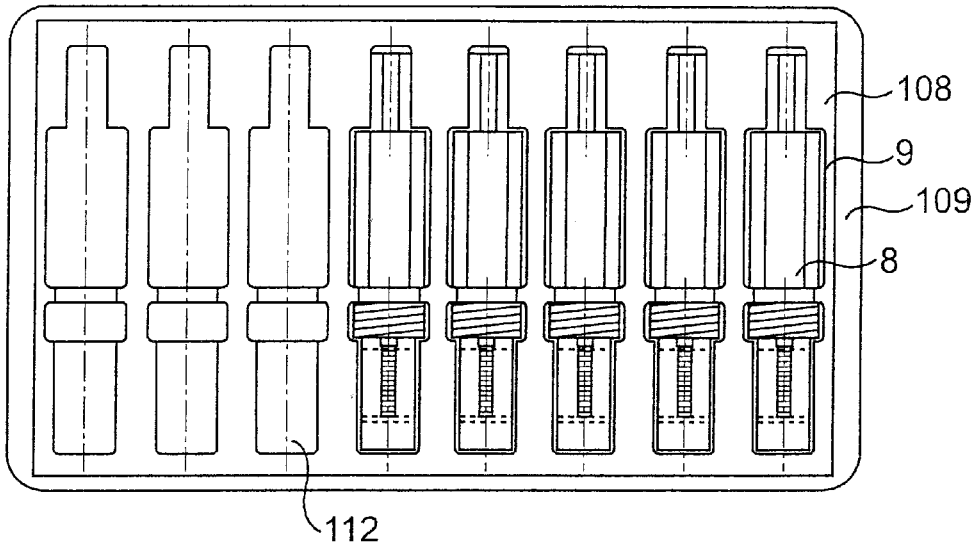
FIG. 3 illustrates a top view of a tray useful in a container according to a second embodiment of the invention including a plurality of magazines stored therein.
Figure 4:
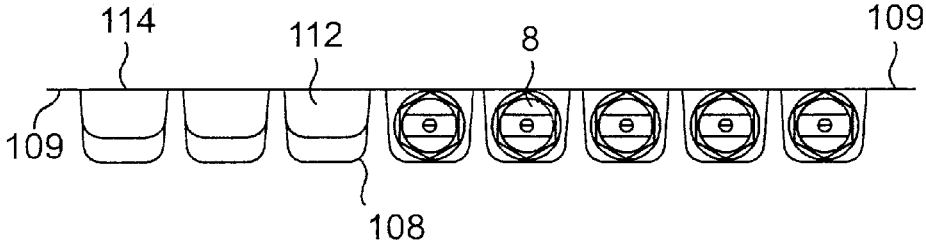
FIG. 4 illustrates a side view of the tray shown in FIG. 3.
Figure 5:
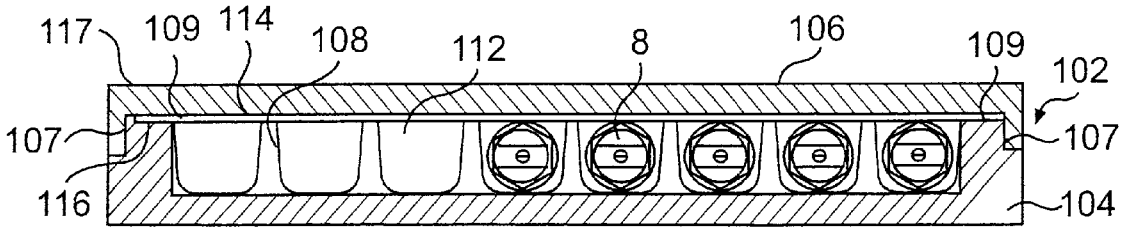
FIG. 5 illustrates a side view of a container according to the second embodiment of the present invention for use in combination with the tray shown in FIGS. 3–4.

FIG. 5 illustrates another embodiment of a container 102 of the present invention, and FIGS. 3 and 4 illustrate a tray 108 to be used in the container 102 illustrated in FIG. 5. Container 102 of FIG. 5 comprises a lower portion 104 and an upper portion 106. Lower portion 104 preferably includes a conventional radiation shielding material, such as lead, steel or other appropriate materials. In a more preferred embodiment of the invention, both upper portion 106 and lower portion 104 of container 102 include a radiation shielding material. Upper portion 106 and lower portion 104 may be joined by a closure 107 such as a friction fit, a mechanical fastener, a slip-fit, threads, or other similar closing structures. Tape may be provided on the outside of container 102 to ensure that the container 102 is not opened during transport.

Tray 108 is designed to be placed within container 102. Tray 108 includes a plurality of recesses 112 for holding magazines 8. Recesses 112 are preferably generally cylindrical in shape and more preferably are designed to provide a friction fit with at least a portion of a magazine 8. Most preferably, recesses 112 are shaped to provide a form fit with magazines 8. Recesses 112 hold magazines 8 by limiting their lateral movement within container 102. Tray 108 may be vacuum-formed, molded, or injection molded, for example, and is preferably made from plastic or other suitable material. Tray 108 may be made from, for example, nucleated polypropylenes, polysulfones, polycarbonates, high temperature acrylics or polyether sulfones.

Tray 108 stabilizes magazines 8 during shipment and isolates magazines 8 from direct contact with container 102. In a preferred embodiment of the invention, tray 108 is sterilizable. As such, tray 108 may be placed separately from container 102 in a sterilization unit, such as an autoclave or other conventional sterilization means, to facilitate handling and sterilization of the magazines 8 or may be sterilized together with container 102.

In another embodiment of the invention, tray 108 may include a film 114 to hold magazines 8 in tray 108 against vertical movement. More preferably, film 114 seals tray 108 to permit shipment of sterilized magazines 8. Alternatively, film 114 may include a radioactive shielding material and may optionally provide a seal for tray 108 as well. Film 114 may be any appropriate material, such as foil, a laminate, or the like. In another embodiment, the entire container 102 may be sterilized and sealed in any conventional manner, thereby allowing sterilized magazines 8 to be transported in tray 108 without requiring film 114 to seal the tray 108.

Lower portion 104 of container 102 may optionally include a shelf 116 upon which a peripheral flange 109 of tray 108 may rest when tray 108 is placed within lower portion 104 of container 102. Subsequently, when upper portion 106 of container 102 is put into place to close container 102, peripheral flange 109 is pinched between shelf 116 of lower portion 104 and a mating surface 117 of upper portion 106 to thereby substantially secure tray 108 in lace and prevent movement and shifting of tray 108 during transport of container 102. Peripheral flange 109 may extend for only a portion of the periphery of tray 108 or around the entire periphery.

Tray 108 of container 102 allows a plurality of magazines 8 to be removed from container 102 and transported and sterilized more easily than if the magazines 8 remained in container 102, e.g., within a medical facility. Additionally, the weight of ,the container 102 is reduced relative to the commercially available container, thereby reducing transportation costs and facilitating the handling of container 102.

To use container 102, magazines 8 are inserted into recesses 112 of tray 108 as shown in FIG. 3. Tray 108 is positioned in lower portion 104 of container 102 as shown in FIG. 5. Radiation shielding provided by lower portion 104 which may include a radiation shielding material may act in cooperation with radiation shielding material 9 of magazine 8 to contain a substantial portion of the radiation emitted by the radioactive material contained in magazine 8. In this manner, the container shown in FIGS. 3–5 minimizes the potential for exposure to radiation even when the container 102 is open.

For storage and/or transport, upper portion 106 of container 102 is placed atop lower portion 104 as shown in FIG. 5 with closure 107 holding upper portion 106 in place on lower portion 104. As can be seen in FIG. 5, upper portion 106 preferably pinches flange 109 of tray 108 atop shelf 116 of lower portion 104 in order to firmly secure tray 108 in position within container 102. Upper portion 106 may optionally include a radiation shielding material to provide additional shielding against radiation emitted in the vertical direction.

Figure 6:
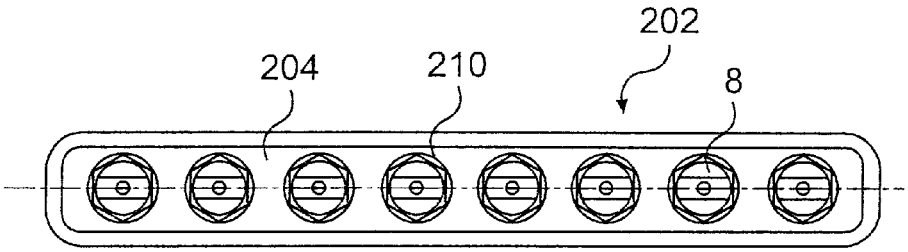
FIG. 6 illustrates a top view of a container according to a third embodiment of the present invention with the upper portion removed.
Figure 7:
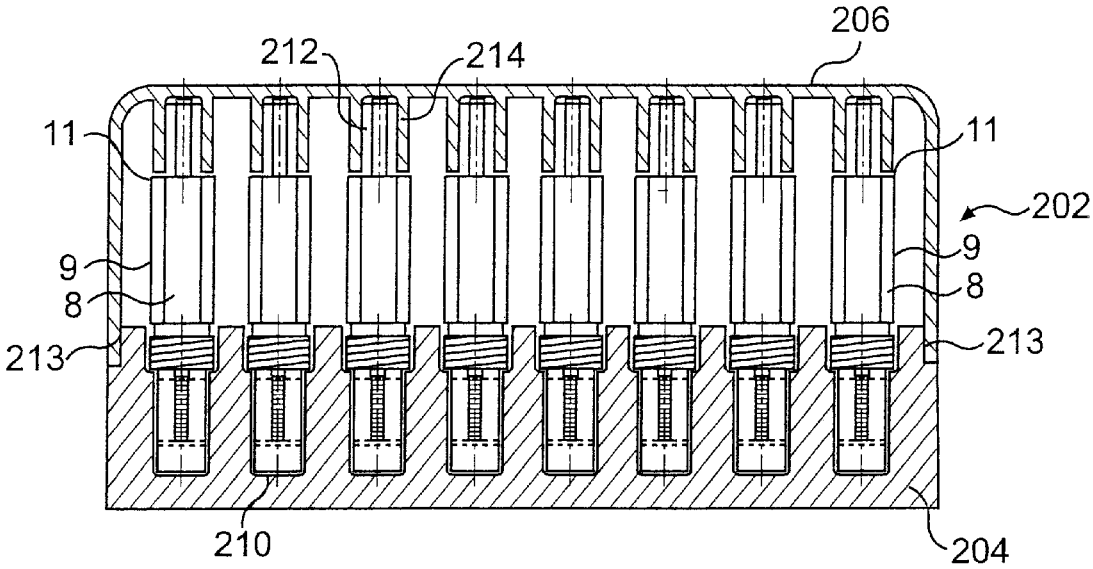
FIG. 7 illustrates a side view of the container depicted in FIG. 6 with the upper portion in place.

FIGS. 6 and 7 illustrate another embodiment of a container 202 of the present invention. Container 202 comprises a lower portion 204 and an upper portion 206. Lower portion 204 includes a conventional radiation shielding material, such as lead, steel or other appropriate materials. In a more preferred embodiment of the invention, upper portion 206 of container 202 also includes a radiation shielding material. Alternatively, upper portion 206 may be made of a material which does not act as a shield against radiation, such as a light-weight plastic, or other appropriate material. Upper portion 206 may be made from, for example, nucleated polypropylenes, polysulfones, polycarbonates, high temperature acrylics or polyether sulfones. Use of plastic in upper portion 206 further reduces the total weight of the container 202, with a possible weight reduction 40–45%, versus use of lead. Reduced weight reduces costs for shipping and transporting container 202 and makes it easier to handle. Upper portion 206 and lower portion 204 may be joined by a closure 213 such as a friction fit, a mechanical fastener, threads, a slip-fit, or other similar closing structures and may be taped closed to ensure that the container 202 is not opened during transport.

Lower portion 204 includes recesses 210 to receive magazines 8. Recesses 210 are preferably cylindrical in shape and more preferably recesses 210 provide a friction fit with at least a portion of a magazine 8 or form fit with the entire magazine 8. In one embodiment of the invention, it may be desirable to isolate magazines 8 from lower portion 204 through use of a plastic sleeve (not shown) or other appropriate device such as those described in the other embodiments of the present invention. A plastic sleeve may be placed over magazines 8, or may be placed in recesses 210.

Upper portion 206 of container 202 includes a plurality of holders 212 formed by projections 214, each holder 212 designed to receive an end of a magazine 8. Upper portion 206 and lower portion 204 are manufactured so that holders 212 align with recesses 210 when the container 202 is closed, thereby allowing each magazine 8 to be secured against lateral movement by a combination of the action of holders 212 and recesses 210. Moreover, projections 214 of upper portion 206 can be fabricated to be closely adjacent to, or in abutment with, upper surfaces 11 of magazine 8 when container 202 is closed to further secure magazines 8 against vertical movement in container 202. Upper portion 206 may be placed on lower portion 204, thereby enclosing magazines 8 within container 202. More specifically, magazines 8 are preferably enclosed within holders 212 and recesses 210 to prevent lateral movement thereof as shown in FIG. 7.

To use the container shown in FIGS. 6–7, magazines 8 are placed into recesses 210 of lower portion 204 of container 202 as shown in FIG. 7. In this position, without upper portion 206 of container 202, the radiation shielding material which may be contained in lower portion 204 may cooperate with the radiation shielding material 9 of magazines 8 to together contain a substantial portion of the radiation emitted by the radioactive material contained in magazines 8. In this manner, the potential for exposure to radiation is minimized, even when container 202 is open.

For storage and shipment, upper portion 206 of container 202 is placed atop lower portion 204 shown in FIG. 7 and the closure 213 maintains upper portion 206 in position on lower portion 204. Upper portion 206 provides vertical and additional lateral stability to magazines 8 by virtue of holders 214 which limit lateral movement of magazines 8 and which are closely adjacent to, or in abutment with, upper surface 11 of magazines 8 to thereby also limit vertical movement thereof. Upper portion 206 may optionally include a radiation shielding material to provide additional shielding against radiation emitted in the vertical direction.

According to an alternative embodiment of the present invention, lower portion 204 and upper portion 206 may be placed in a sterilization unit, such as an autoclave or other conventional sterilization means and subsequently sealed in any conventional manner. This allows container 202 to store and transport magazines 8 in a sterilized condition.

These and other embodiments and uses of the invention will be apparent to those skilled in the art from consideration of the specification and practice of the invention disclosed herein. For example, containers may be altered to accept magazines of various sizes and shapes. The specification and examples should be considered exemplary only. The scope of the invention is only limited by the claims appended hereto.

What is claimed is:

1. A container for housing at least one device which contains radioactive material therein, said device being selected from the group consisting of magazines containing a plurality of radioactive seeds and magazines containing one or more needles pre-loaded with implantable radioactive material, said container comprising:

a first portion which includes a radiation shielding material;

a second portion which, when associated with the first portion, encloses the at least one device; and a removable structure which is specially adapted for securely retaining the at least one device in said first portion to resist movement of said at least one device in said first portion during transport and use whereby the radiation shielding material of said first portion contains at least some of the radiation emitted by the radioactive material in the at least one device.

2. A container as claimed in claim 1, wherein said structure for retaining the at least one device in said first portion comprises a basket including at least one recess therein, each said recess being adapted for retaining at least one device therein.

3. A container as claimed in claim 1, wherein said structure for retaining the at least one device in the first portion includes at least one recess for receiving and retaining at least one device therein, and wherein said container further comprises a means for releasably securing the at least one device in the at least one recess.

4. A container as claimed in claim 3, wherein said means for releasably securing the at least one device in the at least one recess is selected from a friction fit or a form fit between said at least one recess and the at least one device, a mechanical fastener, and a thread provided in said at least one recess which mates with a thread provided in the at least one device.

5. A container as claimed in claim 1 wherein the second portion of the container includes a shoulder which, when the second portion is associated with the first portion to close the container, is positioned closely adjacent to, or in abutment with, an upper surface of the at least one device in order to limit vertical movement of the at least one device within the container.

6. A container as claimed in claim 1, wherein the second portion comprises a radiation shielding material.

7. A container as claimed in claim 1, wherein the structure for retaining the at least one device in the container is a tray provided with at least one recess therein which is adapted to receive and limit lateral movement of the at least one device in said container.

8. A container as claimed in claim 7, wherein the at least one recess in said tray is formed to provide either a friction fit with a portion of the at least one device or a form fit with the at least one device.

9. A container as claimed in claim 7, wherein said tray further comprises a flange which extends along at least a portion of a periphery of said tray, said first portion further comprises a shelf positioned such that said flange rests on said shelf when the tray is located within the first portion, and said second portion further comprises a mating surface which cooperates with said shelf to hold the flange and thereby secure the tray against vertical movement within the container.

10. A container as claimed in claim 1, wherein the device includes a radiation shielding material and the first portion of the container cooperates with the device to shield the radiation emitted by the radioactive material.

11. A container as claimed in claim 1, wherein said second portion includes at least one holder adapted to receive and limit lateral movement of the at least one device and being positioned on said second portion to be in alignment with at least one recess in said first portion when said first and second portions are associated to close the container.

12. A container as claimed in claim 11, wherein the at least one holder extends to a location closely adjacent to, or in abutment with, an, upper surface of the at least one device to thereby limit vertical movement of the at least one device when the first and second portions are associated to close the container.

13. A container for housing at least one device which contains radioactive material therein, said container comprising:

a first portion which includes a radiation shielding material;

a second portion which includes a radiation shielding material; and a holder having at least one recess for retaining the at least one device and limiting lateral movement of the at least one device, and a flange located on at least a portion of the periphery of said holder, and wherein said first and second portions of the container further comprise mating surfaces which cooperate with said flange to ensure that said holder is removably retained within the container.

14. The container of claim 13, wherein at least a portion of each recess in said holder is formed to have a friction fit with a portion of each device to thereby limit lateral movement of the at least one device in said holder.

15. The container of claim 13, wherein each recess in said holder is from fitted to the form of each device to thereby limit lateral movement of the at least one device in said holder.

16. The container of claim 13, wherein the holder comprises a tray having at least one recess adapted to receive the at least one device, and wherein the holder further comprises a film to cover the at least one recess, thereby limiting the vertical movement of the at least one device within the at least one recess of the tray.

17. The container of claim 16, wherein the holder comprises a basket having at least one recess for holding the at least one device; and wherein the second portion of the container further comprises a shoulder positioned such that the basket and the shoulder cooperate to limit both vertical and lateral movement of the at least one device within the container.

* * * * *

Disclaimer 6,531,705—Jack C. White, Alpharetta, GA. (US); Joseph J. Rodgers, Gainesville, GA. (US); Glenn A. Dill, Fayetteville, GA. (US); Mary Christine Jacobs, Atlanta, GA. (US). CONTAINER FOR STORING AND SHIPPING RADIOACTIVE MATERIALS. Patent dated Mar. 11, 2003. Disclaimer filed Apr. 30, 2004, by the assignee, Theragenics Corporation.

The term of this patent shall not extend beyond the expiration date of Pat. No. 6,472,675.

*(Official Gazette March 15, 2005)*